United States Patent [19]

Huebner

[11] Patent Number: 5,038,519

[45] Date of Patent: Aug. 13, 1991

[54] AUTOMATIC WINDOW PANEL ADJUSTMENT CONSTRUCTION FOR VEHICLE WINDOW REGULATOR ASSEMBLIES

[75] Inventor: Mark A. Huebner, St. Clair Shores, Mich.

[73] Assignee: Wickes Manufacturing Company, Southfield, Mich.

[21] Appl. No.: 483,136

[22] Filed: Feb. 22, 1990

[51] Int. Cl.[5] ..... E05F 11/38

[52] U.S. Cl. ..... 49/375; 49/349; 49/352

[58] Field of Search ..... 49/348, 349, 350, 351, 49/352, 353, 227, 374, 375

[56] References Cited

U.S. PATENT DOCUMENTS

| | | | |
|---|---|---|---|
| 1,747,555 | 3/1930 | Zwierzina . | |
| 2,296,811 | 9/1942 | Devereaux | 49/350 |
| 2,398,852 | 4/1946 | Parons | 268/122 |
| 3,591,983 | 7/1971 | Hanson | 49/350 |
| 4,656,780 | 4/1987 | Miyauchi et al. | 49/374 X |

*Primary Examiner*—Philip C. Kannan

[57] ABSTRACT

A cable-type regulator assembly for controlling the movement of a window panel in a vehicle door assembly which incorporates an automatic adjustment bracket to compensate for dimensional variations of components associated with the window panel. The bracket is adjustably mounted on a glider assembly slidably mounted in a track of an elongated rail mounted in the door. The body of the glider assembly is connected to the window panel adjustment bracket by a pair of rivets fitted into associated elongated slots in the bracket and through spider-like spring washers between the heads of the rivets and the adjustment bracket. The rivets and slots permit inboard and outboard, fore and aft and limited pivotal movement of the window assembly during operation. The spider-like washers provide a spring device spring loading the panel assembly during its movement to different positions to ensure that it smoothly travels without vibration and noise regardless of limit stack variations in the doors, window panels, guide tracks or other window regulator elements.

6 Claims, 3 Drawing Sheets

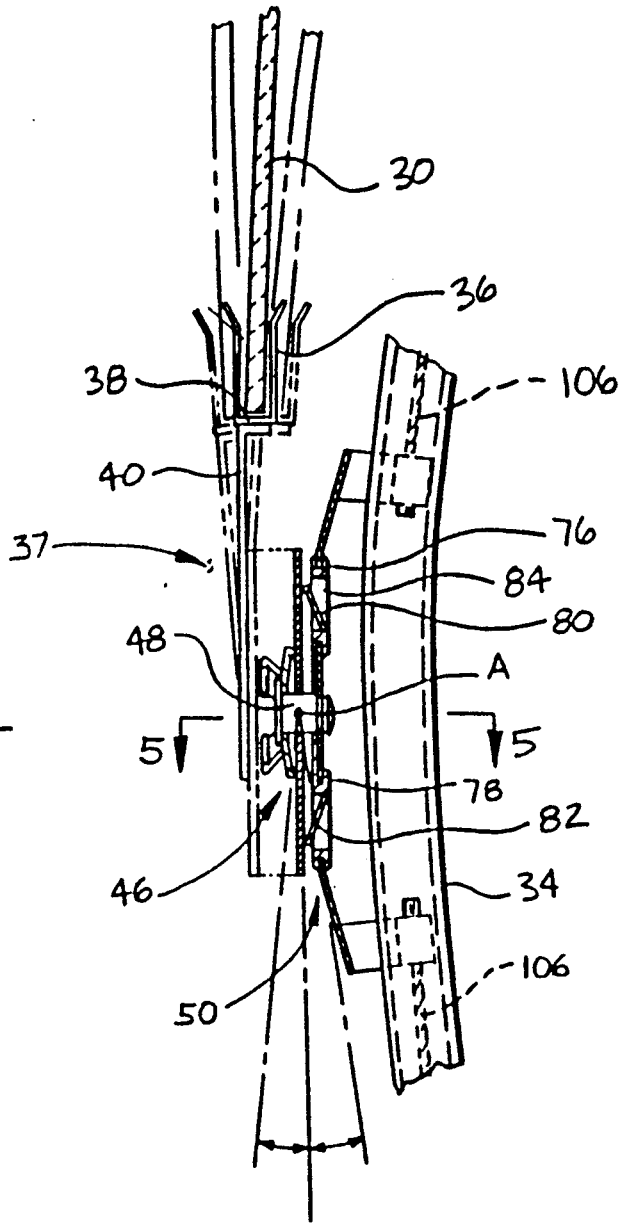
FIG. 4
FIG. 5
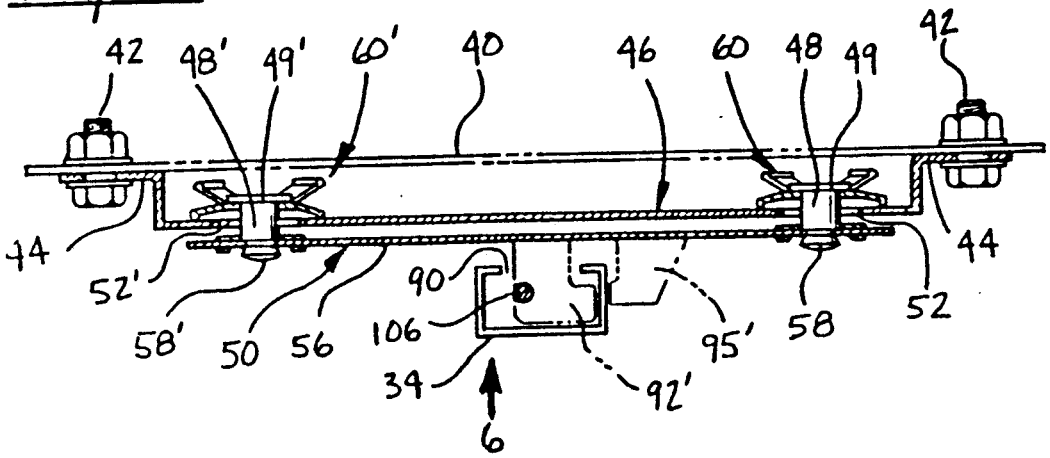

AUTOMATIC WINDOW PANEL ADJUSTMENT CONSTRUCTION FOR VEHICLE WINDOW REGULATOR ASSEMBLIES

TECHNICAL FIELD

This invention relates to window regulators for adjustably mounting window panels in vehicle doors, and more particularly to a new and improved window regulator assembly having an adjustment bracket which is effective to automatically adjust the panel in accordance with limit stack variations in the window panel door, regulator and other associated components to prevent the panel from binding during regulator operation.

In the automatic adjustment bracket of the window regulator of the preferred embodiment of the present invention, two plastic spring washers operatively disposed on one side of the adjustment bracket and two plastic cantilever spring devices overmolded into a supporting rail glide plate and operatively disposed on the other side of the adjustment bracket yieldably support the bracket to prevent vibration and noise that may occur during operation of the window or vehicle. The glass panel and the adjustment bracket can automatically rotate clockwise or counterclockwise in accordance with dimensional variation in the window and window mounting components. Furthermore, the adjustment bracket has a pair of elongated slots through which mounting rivets extend to allow lateral as well as the fore and aft adjustment of the window panel as it is moved to station between its upper and lower limit position. The bracket permits the window to pivot a limited amount about a horizontal axis through the rivets. The spring washers and cantilever springs yieldably hold the window panel in position for stabilized, noise-free adjustment without binding.

These and other features, objects and advantages of this invention will become more apparent from the following detailed description and drawings in which:

DETAILED DESCRIPTION OF THE DRAWINGS

Figure 1:
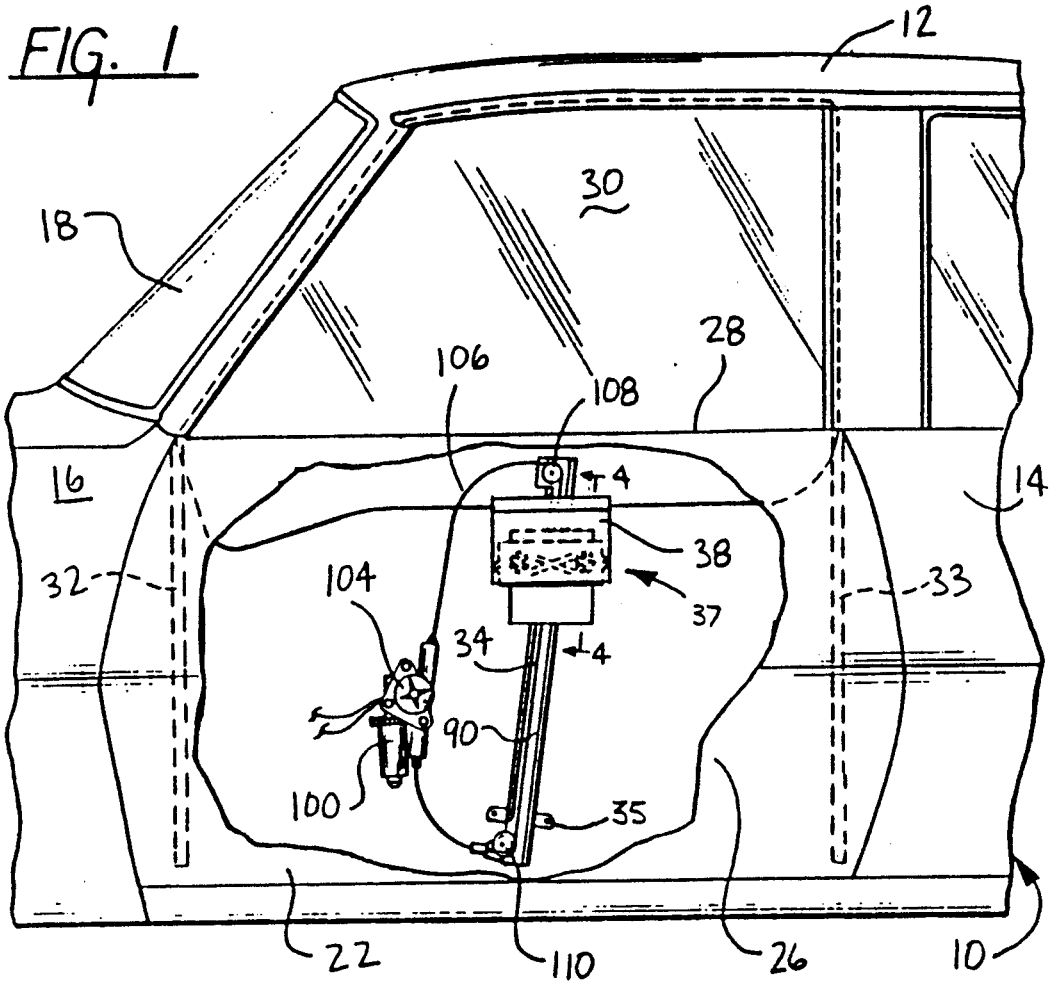
Figure 2:
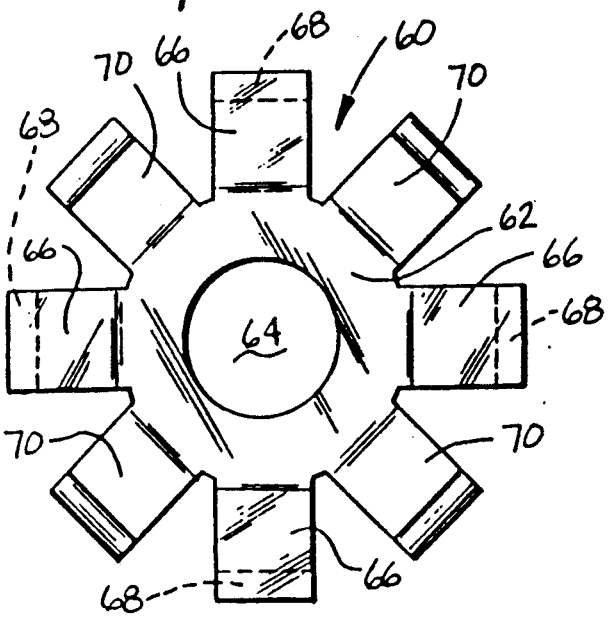
Figure 3:
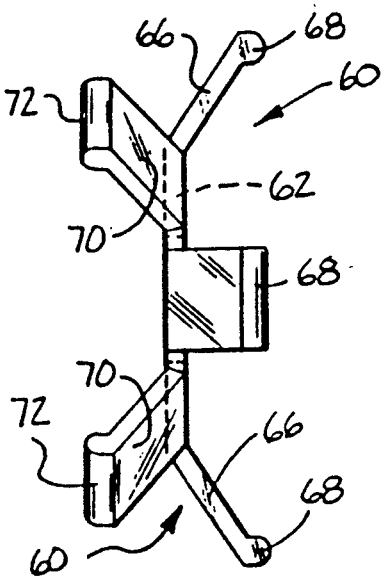
Figure 6:
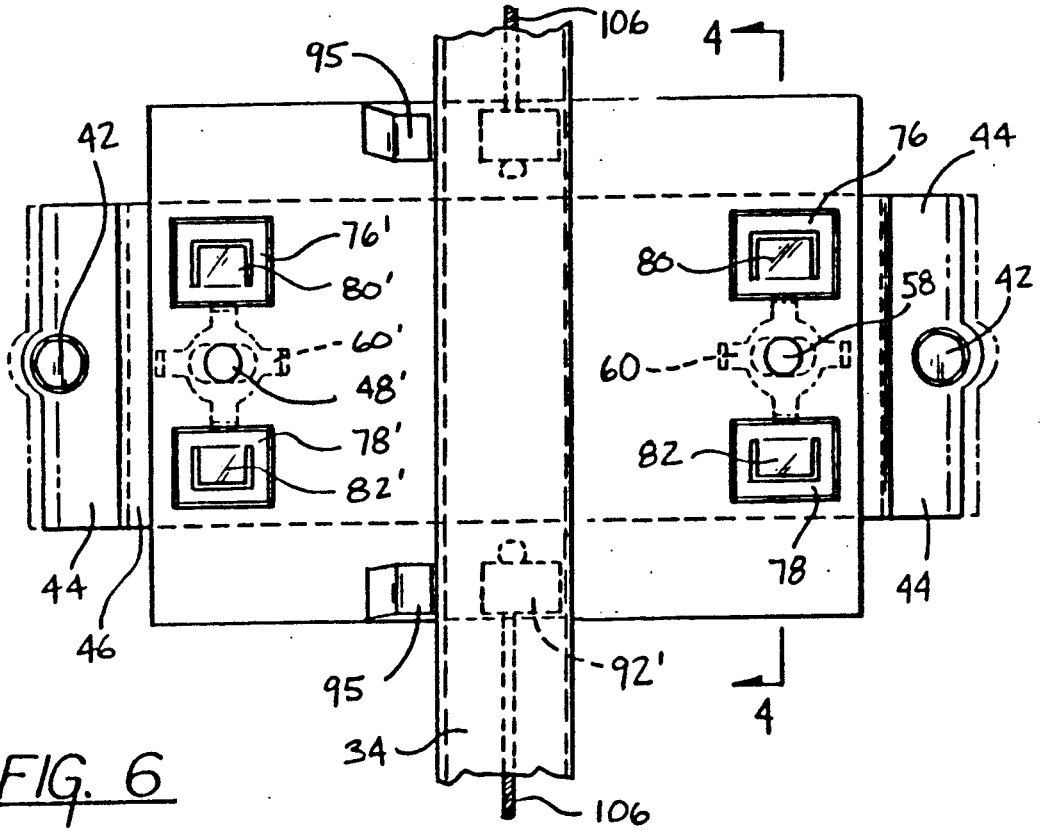

FIG. 1 is a fragmentary, partially broken away elevational view of a body of an automobile having a window panel and regulator in a door thereof, FIGS. 2 and 3 are pictorial top and side views of the plastic spring washers used for the continuous glass panel adjustment provided by this invention, FIG. 4 is a partially sectional view taken along lines 4—4 of FIG. 6, FIG. 5 is a partially sectional view taken along lines 5—5 of FIG. 4, FIG. 6 is an elevational-type view as seen from the view arrow 6 of FIG. 5.

Figure 7:
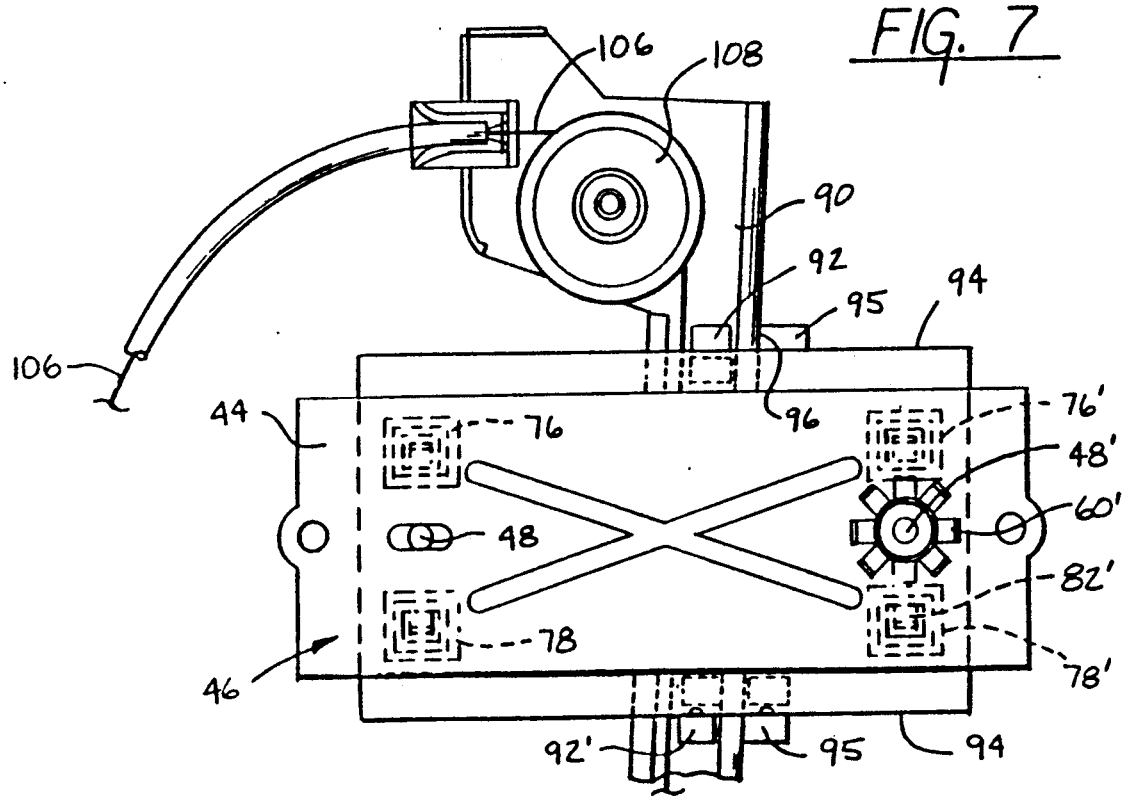

FIG. 7 is an enlarged view of a portion of the regulator assembly of FIG. 1 with parts removed to show details of the window panel adjustment bracket of this invention.

DETAILED DESCRIPTION OF THE PREFERRED EMBODIMENT OF THE INVENTION

Referring now to FIG. 1 of the drawings, a vehicle body generally designated 10 has a roof structure 12, a quarter panel 14 and a front fender structure 16. The forward portion of the roof structure 12 is supported by a pair of pillars 20 partially sealingly retaining a windshield 18, with only one pillar being shown. The roof structure in combination with the quarter panel, fender panel and pillar, defines a door opening within which a door 22 is conventionally, vertically hinged at its forward edge to support structure in the vehicle body 10 for swinging movement between open and closed positions, with the closed position being illustrated in the figure.

The door assembly 22 includes an inner panel 24 and an outer panel 26 spaced therefrom and welded thereto to form a conventional window storage well. The opposite ends of the inner and outer panels converge at the vehicle belt line 28 to form an elongated window panel slot that extends longitudinally of the vehicle body when the door is closed. A safety glass window panel 30 is sealingly and slidably received within the longitudinal slot in the door for movement between a raised position, shown in FIG. 1 and a lowered position, not shown, stowed within the window well. Forward and rear rails or channels 32 and 33 slidedly engage the edges of the window panel just below the vehicle belt line during movement of the window panel between the raised and lowered positions. These channels stabilize and guide movement of the window panel during the movement of the window between the raised and lowered positions and are secured by any suitable means within the well of the vehicle door.

To provide for the raising and lowering of the window, there is a guide member in the form of a main rail assembly 34, generally C-shaped in cross-section, section, that is rigidly and non-adjustably secured to the inner panel 24 of the door such as by a bracket 35. The open portion of the rail assembly faces the outer panel 26. The window panel 30 is movably secured to the rail assembly 34 by a window panel support and carrier assembly means 37 that follows the curved path of the rail assembly when moving between the raised and lowered positions. The curvature of the rail assembly 34 is best shown in FIG. 4 to conform to the curvature of the window well as dictated by the styling of the vehicle and the shape of the inner and outer panels of the door.

The window panel support and carrier assembly means 37 includes a U-shaped channel 36 in which the lower edge of glass panel 30 is secured and a flat metal plate 40 that depends downwardly from the channel 36 into the well and is connected by nut and bolt fasteners 42 to the outboard and offset end portions 44 of a generally rectilinear adjustment bracket 46. This adjustment bracket forming part of the window support and carrier assembly means importantly provides for the automatic adjustment of this window panel as it is raised and lowered into position regardless of the limit stack variations of the components of the door, the window panel, the regulator, the channel guide rails, and other associated parts.

The adjustment bracket 46 is connected by a pair of laterally spaced and elongated shouldered rivets 48, 48' which connect into a glider or carrier assembly 50 of the window panel support and carrier assembly 37. These rivets 48, 48' are substantially identical and have enlarged heads 49, 49' with shanks that extend through elongated and laterally extending adjustment slots 52, 52' in the rectilinear, central body portion of the adjustment bracket 46. From the shoulder of each of these rivets, the reduced diameter ends thereof extend through associated openings in the flattened support plate 56 of the carrier 50 where they are headed over at 58, 58' so that they are trapped and rigidly secured to the support plate. The adjustment slots allow for the fore and aft adjustment of the window panel and the regulator components because of dimensional variations of components such as the guide channels 32, 33, door panels and the regulator components.

Multi-armed adjustment spring washers 60, 60', preferably of an engineering plastics material such as DELRIN or of a spring metal are mounted on the rivets and are operatively interposed and spring loaded between the enlarged head of the rivets 48, 48' and the main body of the adjustment bracket.

The adjustment springs used in this invention exemplified by spring 60 of FIGS. 2 and 3, have a flat, washer-like center portion 62 defining an annular axial opening 64 to fit the diameter of the main shank of the associated rivet 48. From the outer extent of the center portion, the adjuster spring 60 has four arcuately spaced and inwardly extending spring arms 66 spaced at 90° from one another and terminating in contact pads 68 which, in the installed position are spring loaded against the adjustment plate 56. These spring arms flex on the lateral in and out adjustment of the window panel and to support brackets on rivets 48, 48' in accommodating dimensional variations in the regulator and other support components.

In addition to the spring arms 66, the adjusting spring 60 has similar, arcuately spaced arms 70 that project in an opposite direction as compared to the arms 66 and terminate in contact pads 72. In the installed position shown in the Figures, the contact pads 72 do not engage the mounting plate 40, but this construction provides a spring device which is reversible and completely functional regardless of the direction of installation. Also, in the event of the breakage or fatiguing of one of the active arms 66, for example, the spring washers could be reversed in a repair procedure and provide for effective adjustment and anti-rattle functions.

While the adjustment spring provides for the automatic and rattle-free automatic adjustment of the bracket relative to the glider carrier as will be further described hereinafter, a pair of back pads 76, 78 and 76,, 78, which carry cantilever springs 80, 82 and 80', 82' that extend through openings such as the openings 84 and 86 in pads 76, 78 may also be effectively employed in this invention. These cantilever springs have terminal contact with the backside of the adjustment bracket 46 as best shown in FIG. 4 to provide yieldable spring support of the adjustment bracket relative to the glider assembly 50. These cantilever spring arms accordingly are effective in reducing vibration and resulting rattle and add to the self adjustment provided by the adjustment bracket 46 in its travel in the rail assembly raising and lowering the window panel 30.

The elongated and curved rail assembly 34 has an outboard opening 90, as shown in FIGS. 1 and 6, that receives the plastic glides 92, 92' mounted to upper and lower edge portions 94 and 94' of the support plate 56 of the carrier assembly. In addition to the glides 92, 92', the support plate 56 has a stabilizer glide 95, 95' which ride along the outboard side of rail 32 to provide a narrow guideway 96, 96' to stabilize the window panel as it is being raised and lowered by the regulator of this invention.

The window panel, along with the adjustment bracket, are raised and lowered by means of an electric energizable motor drive mechanism 100 controlled by an operator in the vehicle through a switch and electrical circuitry, not illustrated. The motor is connected to rotate a conventional cable drum in housing 104 to move a cable 106 that leads across the upper and lower pulleys 108 and 110, and from these wheels the cable connects into the glides 92, 92' as diagrammatically shown in FIGS. 4 and 6.

In operation, the operator can raise or lower the window by energizing the motor to effect the movement of the cable to cause the cable to move the window support and carrier assembly means 37. As the adjustment bracket assembly and the attached window panel move downward for example, the window panel and support can shift fore and aft in the rivet slots as demanded by the limit stack and dimensional variations of the components of the window regulator, the guide channels, or the variations in the window panel itself. Furthermore, the window panel can shift inboard or outboard to accommodate the tolerance variations. If pivoting is required, the window can, for example, pivot about the longitudinal axis A, shown in FIG. 4, to some limited extent with the spring arms of the washer assemblies and the cantilever spring, providing for smooth travel while the movement is being accomplished and to hold the window in a spring-loaded position so that vibration and rattle are reduced to a minimum.

The glass panel 30 and the adjustment bracket can also experience limited rotatin vertically while riding on the rivets 49 secured to support plate 56. The axis of such rotation would be on a center line between the two rivets bisecting the bracket in FIG. 1.

It will be appreciated that the foregoing disclosure relates to a preferred embodiment of the invention and is intended to illustrate the invention for purposes of disclosure of the principles thereof and not to disclose all possible changes and modifications which may now be apparent to those skilled in the art. Accordingly, the scope of this invention is set forth in the appended claims.

What is claimed is:

1. An automatic adjustment support for a window panel mounted to carrier structure of a window regulator assembly that travels between a lower stop position within a well in a vehicle door and an upper stop position, the window panel being movable to a wide range of different positions as selected by an operator and between said upper and lower stop positions, the improvement comprising:

an adjustment bracket means incorporating a body portion with spring loaded mounting pin and slot means securing said adjustment bracket means to said carrier structure, the pin being movable longitudinally and laterally within the slot to permit said window panel to automatically self adjust with a minimized vibration and noise to different fore and aft and inboard and outboard positions with respect to said carrier to accommodate dimensional variations of a regulator assembly structure and for dimensional variations in components associated with said window panel to minimize binding of said window panel as it travels between said lower and upper stop positions.

2. The automatic window panel adjustment support of claim 1, wherein said mounting pin means have head means, and further including:

resilient spring means operatively disposed between said head means of said mounting pins means and the adjustment bracket means so that the springs flex to allow the window panel to adjust under spring loaded conditions in inboard and outboard directions as the window is raised and lowered by said window regulator.

3. The panel adjustment of claim 2 wherein said resilient spring means is a multi-armed spring having a washer-like center portion and a first array of arcuately spaced arms disposed from said center portion which are spring-loaded onto the adjustment bracket means.

4. The panel adjustment of claim 3 above, wherein said spring has a second array of arms extending in a direction opposite to the direction of the first array of arms that said spring means is operative in either direction of installation on said pin means.

5. An automatic window adjustment support for a window panel mounted to a movable support structure of a window regulator assembly, said window panel being movable between a lower stop position within a well of a vehicle door and an upper stop position in which the window panel can be moved to any one of a range of varying positions as limited by said upper and lower stop positions, the improvement comprising:

an adjustment bracket means having longitudinally extending slot means therefor, associated pin means having an enlarged head portion with depending shanks that extend through said slot means in said adjustment bracket means to support and permit said window to automatically adjust for variations in build tolerances of said door and for limited pivotal movement in accordance with dimensional variations occurring in components associated with said window so that said window can be raised and lowered without binding and with freedom from vibration and rattle, said movable support structure including carrier means rigidly supporting said means so that they project through elongated slots in said adjustment bracket means and spider spring washer means supported on said pin means and effective on one side of said adjustment bracket and cantilever spring means on the other side of said adjustment bracket and supported by said carrier to spring load said adjustment bracket to allow said bracket to have limited adjustment movement during its travel with said carrier means between the upper and lower limit position to accommodate for variations in the support structure and the vehicle door construction.

6. A window regulator for moving a window panel in a well of a vehicle door between upper and lower limit positions comprising:

a rail assembly fitted in the window well of a vehicle door, a glide assembly operatively mounted to said rail for moving said window panel, motor means associated with said glider assembly for moving said glider assembly in said rail assembly, and elongated mounting pin and slot means mounting the window panel on the glide assembly to enable the adjustment of said window fore and aft and in and out during movement of said window panel into an infinite number of positions during its movement between said limit positions.

* * * * *